US006310434B1

(12) United States Patent
Van Zutphen et al.

(10) Patent No.: US 6,310,434 B1
(45) **Date of Patent: *Oct. 30, 2001**

(54) PICTURE DISPLAY DEVICE HAVING AN IMPROVED BANDWIDTH

(75) Inventors: Tom Van Zutphen; Jacobus Stoffels, both of Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,457

(22) Filed: Jun. 24, 1998

(30) Foreign Application Priority Data

Jun. 25, 1997 (EP) ..... 97201943

(51) Int. Cl.[7] ..... H01J 29/04

(52) U.S. Cl. ..... 313/446; 313/447; 313/336; 348/809

(58) Field of Search ..... 313/336, 309, 313/346 R, 346 DC, 446, 417, 447; 348/809

(56) References Cited

U.S. PATENT DOCUMENTS

| | | | | |
|---|---|---|---|---|
| 3,873,876 | * | 3/1975 | Yamauchi | 313/409 |
| 4,002,884 | * | 1/1977 | Weiss | 313/340 |
| 4,604,647 | * | 8/1986 | Peele | 348/809 |
| 4,720,654 | | 1/1988 | Hernqvist et al. | 313/414 |
| 5,341,064 | * | 8/1994 | Seong | 313/446 |
| 5,548,184 | * | 8/1996 | Choi et al. | 313/346 R |
| 5,585,689 | * | 12/1996 | Imura et al. | 313/336 |

* cited by examiner

*Primary Examiner*—Michael H. Day

(57) ABSTRACT

A picture display device having a cathode which includes two electric current conductors between which a video signal is applied, for applying a video signal to the cathode to modulate an electron beam emitted from the cathode. To increase the feasible modulation frequency, the inductance of the two electric conductors is reduced by holding one part of the length of the conductors closer together than their spacing over another part of the same length.

20 Claims, 3 Drawing Sheets

PICTURE DISPLAY DEVICE HAVING AN IMPROVED BANDWIDTH

BACKGROUND OF THE INVENTION

The invention relates to a picture display device provided with a cathode ray tube comprising a base, an electron gun and a cathode, the cathode having electric current conductors which are connected to external electronics via the base. The invention also relates to a cathode ray tube comprising an electron gun with a cathode.

A cathode ray tube for a monochrome picture display device, for example a television or a monitor, has a display screen with a phosphor layer. The cathode ray tube also comprises an electron gun which emits an electron beam during operation. This beam can be controlled by means of deflection coils which generate a given magnetic field towards a given location on the display screen.

The display screen is activated by scanning the electron beam across the screen, which beam is modulated by a video signal. This video signal ensures that the phosphor is excited in accordance with such a pattern that a picture is produced when the phosphor luminesces. When many electrons land on the pixel during the excitation time of a pixel, this pixel lights up more brightly. The video signal is applied to the cathode via electric current conductors each connected to a pin in the base. These electric current conductors are shown, for example in the electron gun depicted in FIG. 3 of U.S. Pat. No. 4,720,654.

There are many pixels per surface unit. Moreover, the pixels are excited one after the other within a very short time. The viewer thereby experiences a moving image at a normal viewing distance.

In a color display device, for example a color television or a color monitor, each pixel has three phosphor elements each luminescing in a different primary color. As it were, there are three uniform, regular patterns on the display screen, each pattern having a different luminescence color. Instead of one electron beam, three electron beams from three different cathodes in the color electron gun are scanned across the screen during operation. Each of these three beams excites the pixels of a given luminescence color. Since the phosphor elements of a pixel are located close together, the viewer experiences them as a single element instead of separate elements. The color which is experienced is a mixed color of the three elements. By exciting each element at a given intensity, the viewer experiences a given color. For example, if the red element and the blue element are fully excited and the green element is partly excited, the viewer will experience the mixed color of purple. Similarly as in a monochrome cathode ray tube, the pixels are located so close together that the viewer does not see them as separate pixels from a normal viewing distance. This results in a color image.

The known picture display devices have a considerable drawback in that the image is not sharp enough, notably for monitor applications.

It is, inter alia, an object of the invention to obviate the above-mentioned drawback. More particularly, it is an object of the invention to provide a picture display device in which the displayed image is sharp enough for monitor applications.

SUMMARY OF THE INVENTION

This object is achieved with a picture display device provided with a cathode ray tube comprising a base, an electron gun and a cathode, the cathode having electric current conductors between which a video signal is applied and which are connected to external electronics via the base, which picture display device according to the invention is characterized in that over a part of their length the conductors within the cathode ray tube at least partly engage that is, are held close to, each other and are separated by an insulating material. By using this measure, the inductance of the circuit of electric current conductors and cathode decreases and the modulation frequency of the electronic drive unit can be increased. The achievable bandwidth is thereby increased. This provides the possibility of addressing a display screen with more pixels. When the display screen of a picture display device has more pixels per surface unit, the resolution is higher and the image is thus sharper. An additional advantage is that less power is required to drive the cathode.

The picture display device is preferably provided with a cathode having electric current conductors each being band-shaped and partly overlapping each other over a given distance, while the insulating material is a layer located between these two electric current conductors. It is common practice that the electric current conductors of a cathode in an electron gun are band-shaped.

The invention can be implemented easily in this way because it is not necessary to deviate much from the customary design. The lead-throughs in the base can remain as they are in the conventional picture display device.

In accordance with a further preferred embodiment, the electric current conductors have apertures through which the insulating material located between the electric current conductors projects and thus anchors the electric current conductors together. Due to this way of connection, the electric current conductors are secured to each other in an extra tight manner. Due to the projections, the tensile strength rather than the (much smaller) shearing strength is decisive for this tightness.

In accordance with a further preferred embodiment, the electric current conductors are double-folded in the longitudinal direction, at least over a part of their length, so that they have a U-shaped cross-section and are interleaved in such a way that one limb of the U of both electric current conductors extends between the limbs of the U of the other electric current conductor, the electric current conductors being separated from each other by an insulating layer.

In accordance with a further preferred embodiment, at least one electric current conductor has at least one lug which is folded around the other current conductor. One electric current conductor may have, for example two lugs, at the beginning and the end of the piece where both electric current conductors engage each other. The lugs are folded around the other electric current conductor so that shearing is inhibited. The lugs must be insulated from the electric current conductor around which they are folded.

In accordance with a further, favorable preferred embodiment, the cathode is a semiconductor cathode. Such a semiconductor cathode is described in, for example U.S. Pat. No. 5,864,201 issued Jan. 26, 1999. In a picture display device with an electron gun provided with a semiconductor cathode, the advantage of the invention becomes particularly manifest. In fact, a cathode of this type is located closer to the first lens of the electron gun than a cathode of a different type. Consequently, the parts of the electric current conductors located in the envelope of the cathode ray tube are longer than in a different type of cathode. Consequently, the circuit of electric current conductors and cathode has a higher inductance than in other cathodes and its decrease is thus extra important.

These and other aspects of the invention are apparent from and will be elucidated with reference to the embodiments described hereinafter.

DESCRIPTION OF THE PREFERRED EMBODIMENTS

Figure 1:
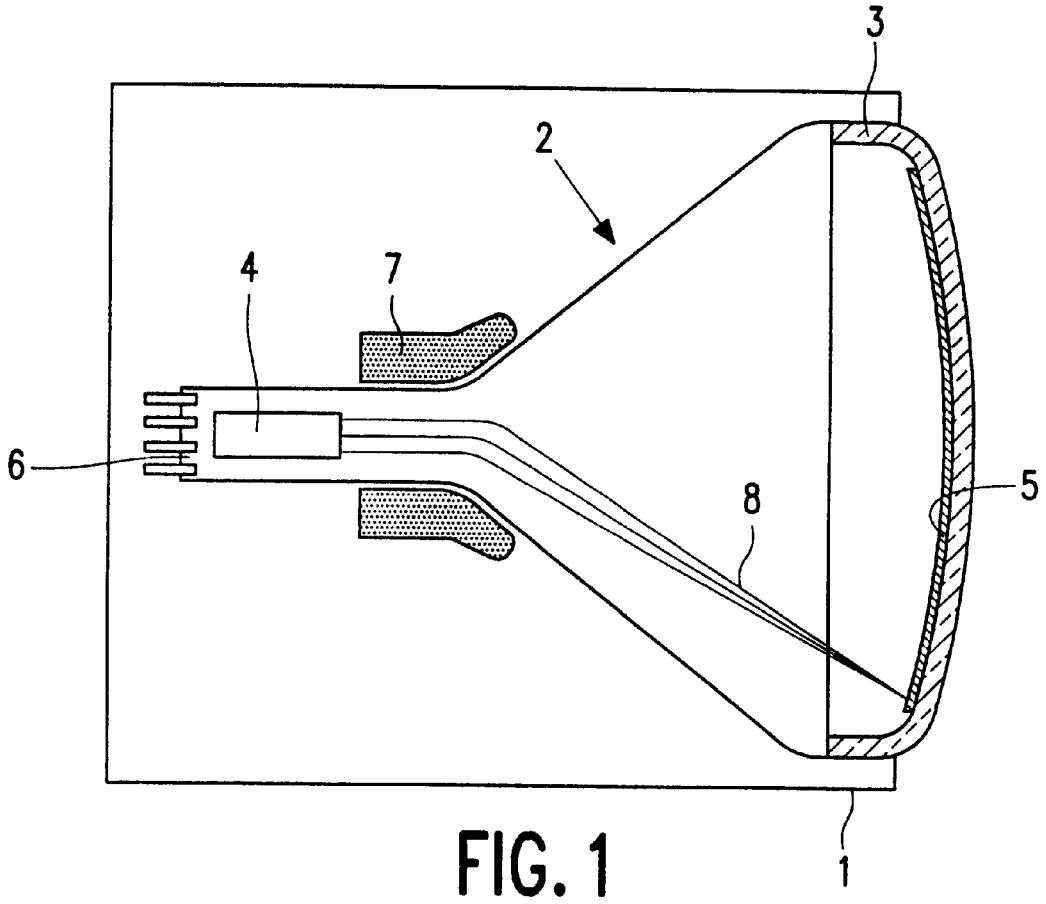
FIG. 1 is a diagrammatic cross-section of a picture display device with a cathode ray tube.

FIG. 1 is a diagrammatic cross-section of a picture display device with a cathode ray tube. A housing 1 accommodates a cathode ray tube 2. The cathode ray tube 2 has a glass envelope 3 within which there is a vacuum and in which an electron gun 4 and a phosphor screen 5 are situated. The reference numeral 6 denotes the base. Deflection coils 7 surround the cathode ray tube. When the device is in operation, the electron gun 4 emits electrons which, if desired, are deflected by the magnetic field generated by the deflection coils 7, whereafter they land at the desired location on the phosphor screen 5. The electron gun comprises one or more cathodes (not shown). In a color display device, three electron beams are generated in operation. The reference numeral 8 denotes these three electron beams in a diagrammatic form.

Figure 2A:
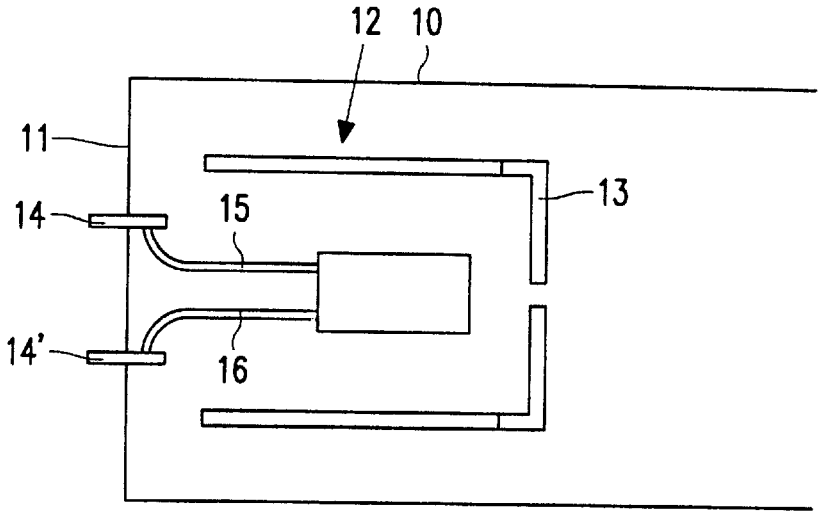
FIG. 2A PRIOR ART
FIG. 2A is a diagrammatic cross-section of a part of the neck of a cathode ray tube and an electron gun in accordance with the prior art.

FIG. 2A is a diagrammatic cross-section of a part of the neck of a cathode ray tube and an electron gun in accordance with the prior art. The neck 10, which is shut off from its surroundings by the base 11, accommodates the electron gun 12. Neck 10 and electron gun 12 are shown only partly in this Figure. The electron gun has a number of electrostatic grids so as to form the electron beam. The first grid G1 (grid 1) 13 is shown in the Figure. The electron gun may accommodate one cathode, as in the gun shown in the Figure. Generally, such a gun is used for a monochrome image. Color display tubes are generally implemented with three cathodes. During operation, a cathode is driven by an assembly of electric current conductors 15, 16 which are connected to pins 14, 14' in the base 11.

Figure 2B:
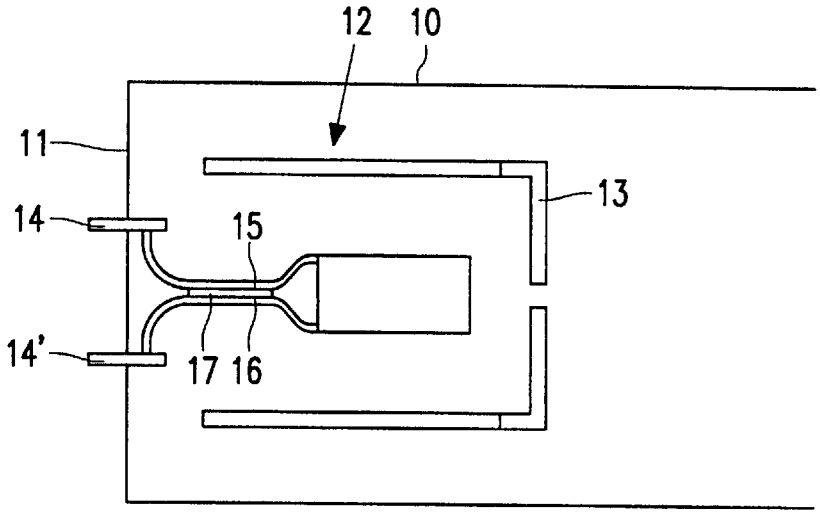
FIG. 2B is a diagrammatic cross-section of a part of the neck of a cathode ray tube and an electron gun according to the invention.
Figure 3:
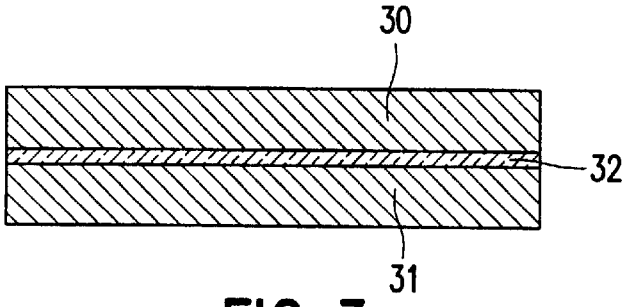
FIG. 3 is a diagrammatic cross-section of an embodiment of an assembly of electric current conductors of a cathode.

FIG. 2B is a diagrammatic cross-section of a part of the neck of a cathode ray tube and an electron gun according to the invention. According to the invention, the electric current conductors 15, 16 are secured together, with an insulating layer 17 in between.

As shown in the drawing, over a substantial part of their length the conductors 15 and 16 are held substantially closer to each other than over another part of their length.

Figure 4:
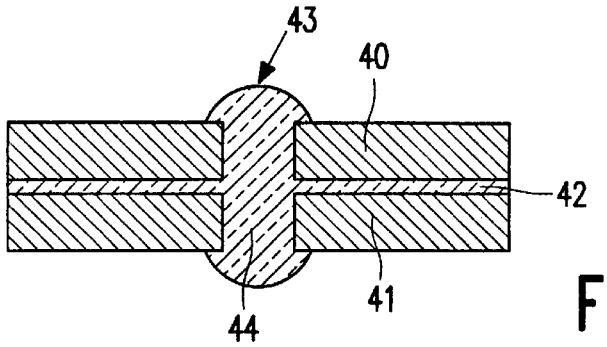
FIG. 4 is a diagrammatic cross-section of an embodiment of an assembly of electric current conductors of a cathode which are anchored together by means of projecting insulating material.

FIG. 4 is a diagrammatic cross-section of an embodiment of an assembly of electric current conductors of a cathode which are anchored together by means of projecting insulating material. In this embodiment, the electric current conductors 40, 41 are also band-shaped. They also engage each other over a large part of their length in the tube, with an insulating layer 42 in between. Now, however, their fixation is strengthened by projections 43 of the insulating material. The electric current conductors have apertures through which the insulator projects. The strength of the assembly is greatly improved in this way. When a force is exerted on the electric current conductors, it should not overcome the shearing strength but the tensile strength which is much larger. Separating two electric current conductors stuck together is easier than breaking the rod 44 produced by way of the connection described above. Consequently, the electric current conductors will get less rapidly separated.

Figure 5:
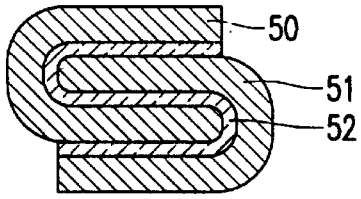
FIG. 5 is a diagrammatic cross-section of an embodiment of an assembly of electric current conductors of a cathode, which assembly has a U-shaped connection.

FIG. 5 is a diagrammatic cross-section of an embodiment of an assembly of electric current conductors of a cathode, which assembly has a U-shaped connection. The strength is also improved in this embodiment. Here again, the electric current conductors 50, 51 are band-shaped and cannot be sheared off because they are folded around each other. An insulating layer 52 is present between the electric current conductors 50, 51.

Figure 6A:
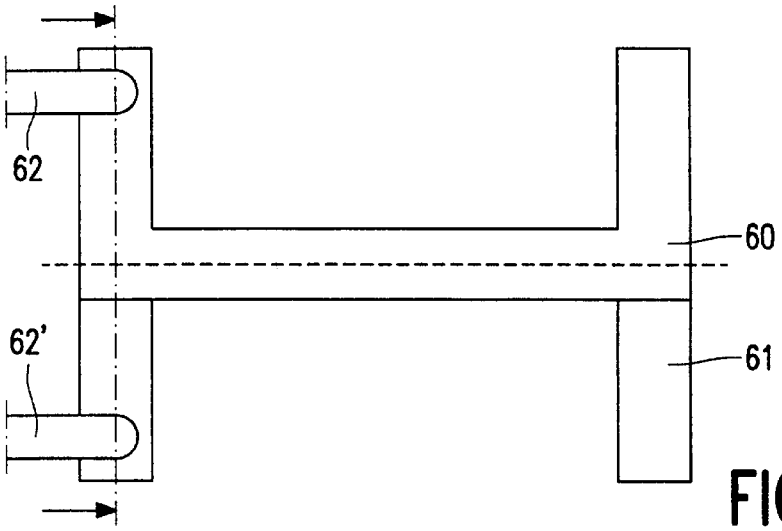
FIG. 6A is a diagrammatic plan view of an embodiment of an assembly of electric current conductors of a cathode.
Figure 6B:
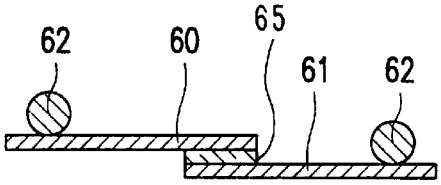
FIG. 6B is a cross-section of one end of the assembly, shown in FIG. 6A, taken on the dot-and-dash line.
Figure 6C:
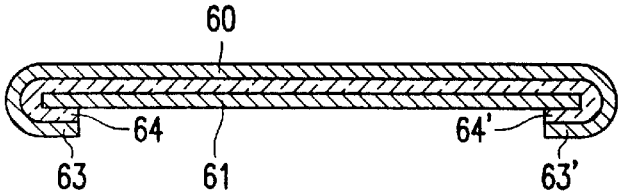
FIG. 6C is a longitudinal section through the assembly, shown in FIG. 6A, taken on the broken line.

FIG. 6A is a diagrammatic plan view of an embodiment of an assembly of electric current conductors of a cathode. The Figure shows how the electric current conductors 60, 61 partly overlap each other. The pins 62, 62' of the base with which the electric current conductors 60, 61 are connected can be seen on one side. FIG. 6B is a cross-section of one end of the assembly, shown in FIG. 6A, taken on the dot-and-dash line. The Figure also shows the insulator 65 which is present between the electric current conductors 60, 61. FIG. 6C is a longitudinal section through the part of the assembly of FIG. 6A where the electric current conductors engage each other, taken on the broken line. Here, one electric current conductor 60 has two lugs 63, 63' at the beginning and the end of the piece where both electric current conductors engage each other. The lugs 63, 63' are folded around the other electric current conductor 61 so that shearing is inhibited. An insulating layer 64, 64' separates the lugs 63, 63' from the electric current conductor around which they are folded.

In summary, the invention relates to a picture display device having an improved bandwidth which is achieved by placing the electric current conductors of the cathode on each other, with an insulating layer in between. In this type of picture display device, the modulation frequency may be higher so that the resolution of the display screen can be increased. An increased resolution yields a sharper image, which is important, especially in monitors.

What is claimed is:

1. A picture display device including a cathode ray tube comprising a base, and an electron gun and a cathode for emitting an electron beam, said base comprising means for connecting to external electronics, and said cathode comprising two electric current conductors between which a video signal is applied, said conductors being respectively connected to said means for connecting, for applying a video signal to said cathode to modulate said electron beam, characterized in that the device comprises means for reducing inductance of said electric current conductors, and said means for reducing comprises an arrangement of said conductors such that over a part of the length of said conductors the conductors are held closer to each other than over another part of the length, and are separated by an insulating material.

2. A picture display device as claimed in claim 1, characterized in that the cathode is a semiconductor cathode.

3. A picture display device as claimed in claim 1, characterized in that the conductors are anchored together by projections of the insulating material through apertures in the conductors.

4. A picture display device as claimed in claim 1, characterized in that at least one of said conductors has at least one lug which is folded around the other conductor so as to inhibit shearing of the conductors.

5. A picture display device as claimed in claim 1, characterized in that the conductors are band-shaped, having a cross section with a width in a width direction greater than a thickness, and overlap each other in said width direction for said part of their length, the overlapped portions of said conductors being separated from each other by a layer of said insulating material.

6. A picture display device as claimed in claim 5, characterized in that at least one of said conductors has at least one lug which is folded around the other conductor so as to inhibit shearing of the conductors.

7. A picture display device as claimed in claim 6, characterized in that the cathode is a semiconductor cathode.

8. A picture display device as claimed in claim 5, characterized in that the conductors are band-shaped, and are double folded in the longitudinal direction over said part of their length, so that the conductors have a U-shaped cross-section and are interleaved in such a way that one limb of the U of each conductor extends between the limbs of the U of the other conductor, the conductors being separated from each other by said layer.

9. A picture display device as claimed in claim 1, characterized in that said part of the length is a substantial part of said length, and over said substantial part of said length said conductors are held substantially closer to each other than over said another part of the length.

10. A picture display device as claimed in claim 5, characterized in that said insulating material is a glass frit.

11. A cathode ray tube comprising a base, and an electron gun and a cathode for emitting an electron beam, said base comprising means for connecting to external electronics, and said cathode comprising two electric current conductors between which a video signal is applied, said conductors being respectively connected to said means for connecting, for applying a video signal to said cathode to modulate said electron beam, characterized in that the device comprises means for reducing inductance of said electric current conductors, and said means for reducing comprises an arrangement of said conductors such that over a part of the length of said conductors the conductors are held closer to each other than over another part of the length, and are separated by an insulating material.

12. A cathode ray tube as claimed in claim 11, characterized in that the cathode is a semiconductor cathode.

13. A cathode ray tube as claimed in claim 11, characterized in that the conductors are anchored together by projections of the insulating material through apertures in the conductors.

14. A cathode ray tube as claimed in claim 11, characterized in that at least one of said conductors has at least one lug which is folded around the other conductor so as to inhibit shearing of the conductors.

15. A cathode ray tube as claimed in claim 11, characterized in that the conductors are band-shaped, having a cross section with a width in a width direction greater than a thickness, and overlap each other in said width direction for said part of their length, the overlapped portions of said conductors being separated from each other by a layer of said insulating material.

16. A cathode ray tube as claimed in claim 15, characterized in that at least one of said conductors has at least one lug which is folded around the other conductor so as to inhibit shearing of the conductors.

17. A cathode ray tube as claimed in claim 16, characterized in that the cathode is a semiconductor cathode.

18. A cathode ray tube as claimed in claim 15, characterized in that the conductors are band-shaped, and are double folded in the longitudinal direction over said part of their length, so that the conductors have a U-shaped cross-section and are interleaved in such a way that one limb of the U of each conductor extends between the limbs of the U of the other conductor, the conductors being separated from each other by said layer.

19. A cathode ray tube as claimed in claim 15, characterized in that said insulating material is a glass frit.

20. A cathode ray tube as claimed in claim 11, characterized in that said part of the length is a substantial part of said length, and over said substantial part of said length said conductors are held substantially closer to each other than over said another part of the length.

* * * * *